United States Patent [19]

Huffman

[11] 4,023,212

[45] May 17, 1977

[54] ADJUSTABLE VISORED CAP WITH INTERCHANGEABLE CROWN

[76] Inventor: Erline L. Huffman, 260 Estero Lane P0621, Litchfield Park, Ariz. 85340

[22] Filed: Sept. 10, 1975

[21] Appl. No.: 611,879

Related U.S. Application Data

[63] Continuation-in-part of Ser. No. 498,652, Aug. 19, 1974, which is a continuation-in-part of Ser. No. 309,184, Nov. 24, 1972, abandoned.

[52] U.S. Cl. ..... 2/197; 2/171.1; 2/DIG. 6; 2/411

[51] Int. Cl.[2] ..... A42B 1/20

[58] Field of Search ..... 2/197, 195, 171.1, 12, 2/3 R, 171.5, 209.5

[56] References Cited

UNITED STATES PATENTS

| | | | |
|---|---|---|---|
| 1,598,313 | 8/1926 | Rosenberg | 2/195 UX |
| 1,598,314 | 8/1926 | Rosenberg | 2/197 |
| 1,665,750 | 4/1928 | McKee et al. | 2/171.5 |
| 2,060,127 | 11/1936 | Schofield | 2/12 |
| 2,218,947 | 10/1940 | Brunzell | 2/195 X |
| 2,855,604 | 10/1958 | Austin | 2/171.1 X |
| 3,353,188 | 11/1967 | Crincic | 2/171.1 |

FOREIGN PATENTS OR APPLICATIONS

| | | | |
|---|---|---|---|
| 1,019,556 | 2/1966 | United Kingdom | 2/197 |

*Primary Examiner*—Werner H. Schroeder
*Assistant Examiner*—Peter Nerbun
*Attorney, Agent, or Firm*—Hauke & Patalidis

[57] ABSTRACT

An adjustable visored cap consisting of integral visor and forehead portions and an interchangeable crown portion provided with adjustable bands for adjustably securing the cap about the head of the wearer.

12 Claims, 12 Drawing Figures

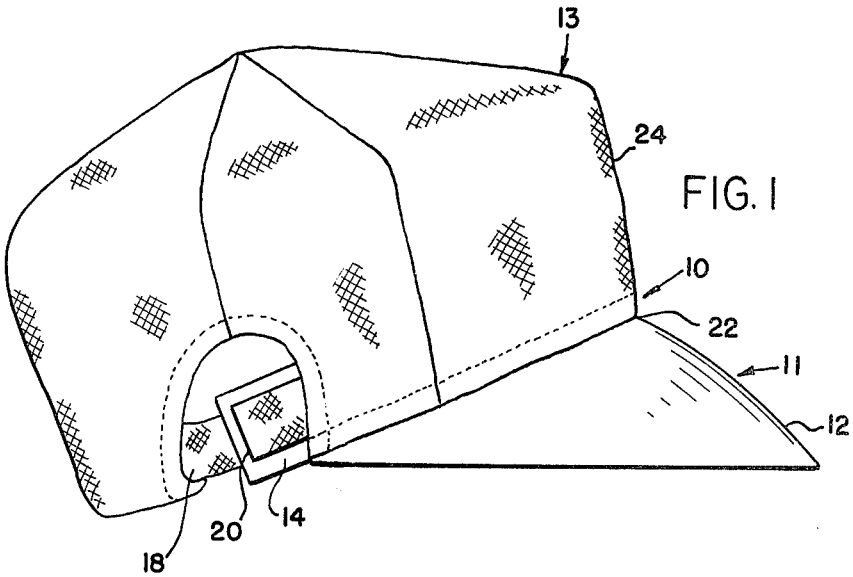
FIG. 1
FIG. 2
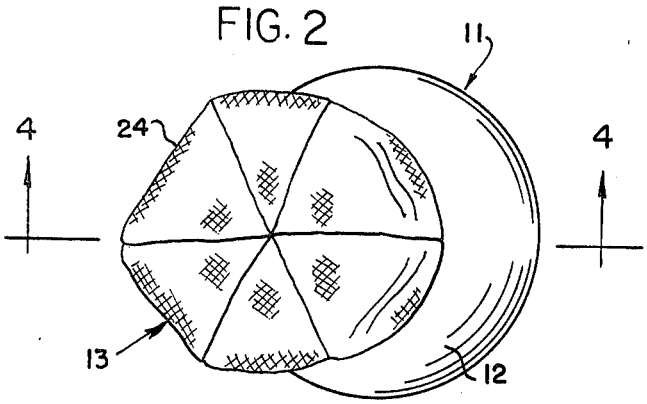
FIG. 3
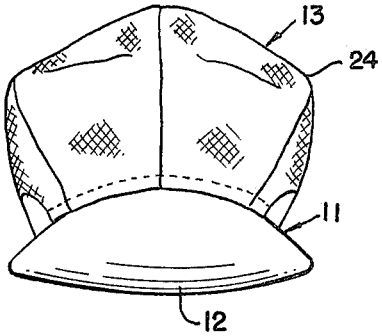
FIG. 4
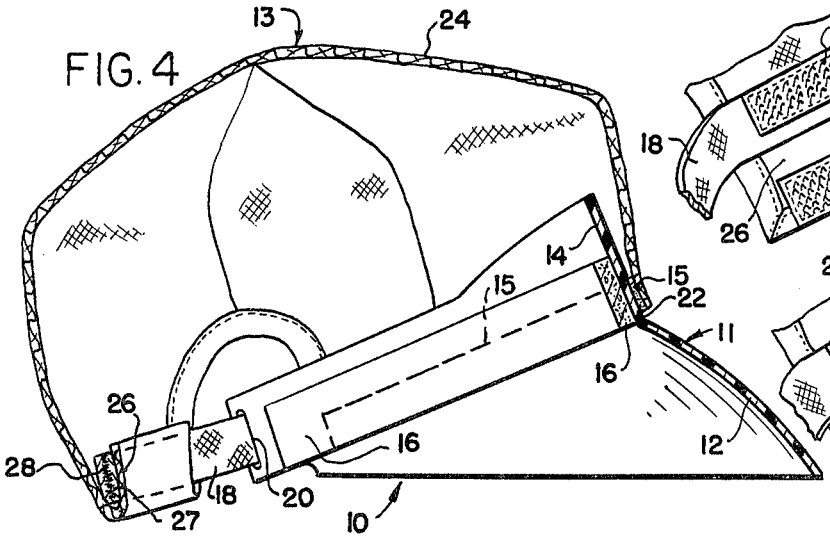
FIG. 5
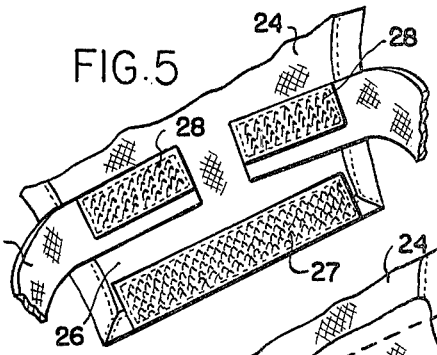
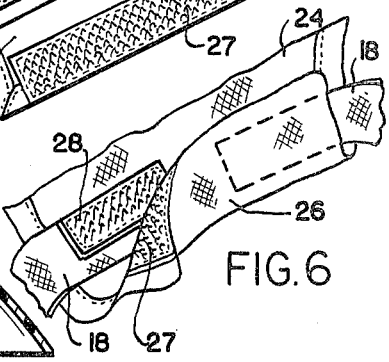
FIG. 6

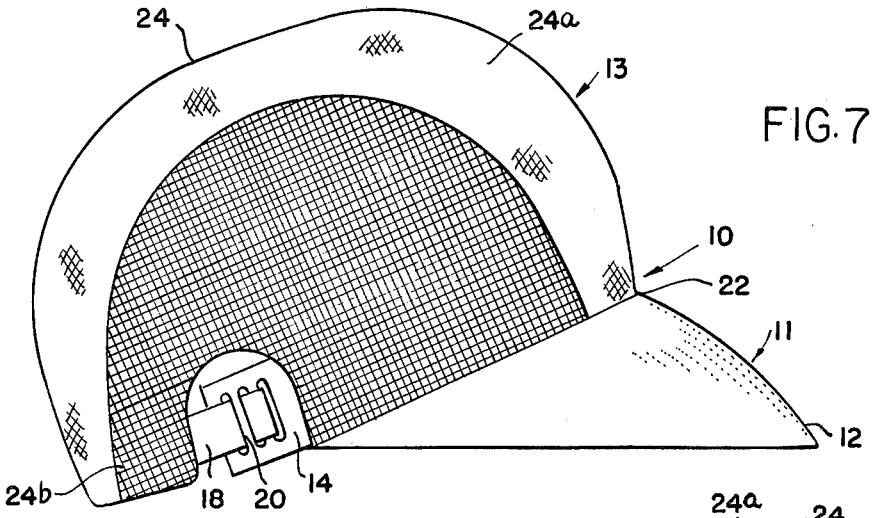
FIG. 7
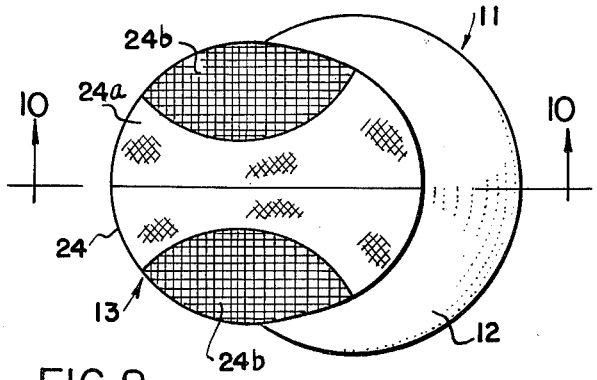
FIG. 8
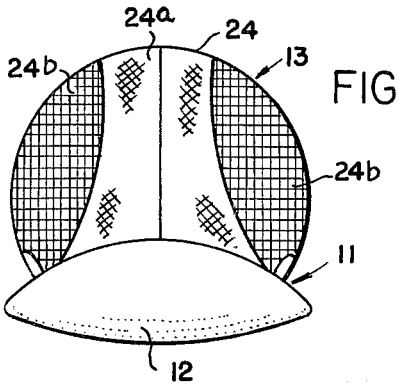
FIG. 9
FIG. 11
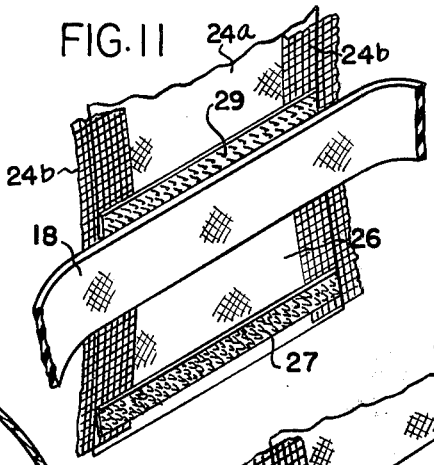
FIG. 10
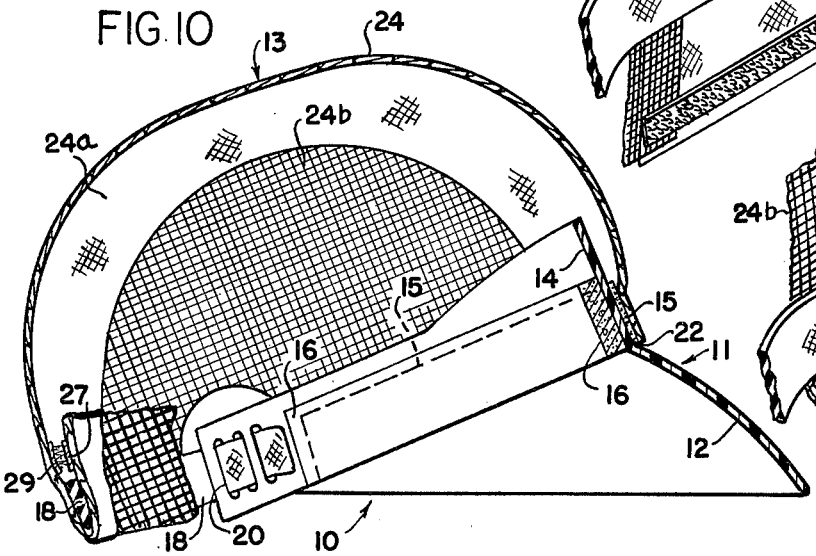
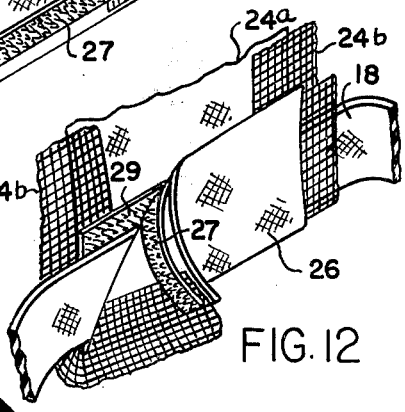
FIG. 12

ADJUSTABLE VISORED CAP WITH INTERCHANGEABLE CROWN

REFERENCE TO RELATED APPLICATIONS

The present application is a continuation-in-part of my application Ser. No. 498,652, filed Aug. 19, 1974, for "Eye Shade with Removable Crown," which was a continuation-in-part of my application Ser. No. 309,184, filed Nov. 24, 1972, now abandoned.

BACKGROUND OF THE INVENTION

Devices adapted to be worn on the forehead of a person to shade the eyes of the wearer are well known in the art. It is also well known to provide such devices with an elongated pad of absorbing material in contact with the forehead of the wearer to absorb perspiration, as disclosed in the hereabove referred to copending application. It is also known to provide caps which may be adjustably secured about the head of the wearer by means of material such as that known under the trademark VELCRO, which has a self-engaging quality, as taught in British patent specification No. 1,019,556.

Eye shades or visors are made of flexible or rigid material, either opaque or transparent, although when transparent the visor is generally colored, and they are held on the forehead by means of an elastic or semi-rigid adjustable band passed over the back of the head and maintaining the shade or visor about the forehead of the wearer. The forehead portion of the visor consists generally of a substantially narrow band which results in appreciable pressure being applied to the wearer's forehead, thus causing appreciable discomfort. When it is desired to combine one of such eye shades or visors with a conventional head gear such as a cap, hat or the like, considerable annoyance and difficulties are encountered.

The inconveniences of the eyes shades of the prior art are remedied by the cap of the present invention which, as a result of being provided with a substantially wide, curved forehead portion lined with a resilient, absorbent material, provides substantially broad area engagement with the forehead of the wearer, thus resulting in a stable and comfortable forehead support. The resilient, absorbent lining further contributes to the comfort of the wearer by absorbing perspiration and by providing a soft contact with the forehead. The visor portion and the forehead portion being molded of a substantially rigid piece of material, preferably plastic material, are substantially resistant to impact, such impact being further partially absorbed by the resilient cushioning provided by the lining. The invention therefore acts not only as an eye shade and cap, but also as an impact protective device for a substantial portion of the wearer's head.

A further advantage of the present invention resides in providing an interchangeable crown portion which may be removably affixed to the forehead portion of the visor by means of adhesive or, alternatively, by means of self-engaging material. The invention results in a simply manufactured device with the additional benefit of a crown portion that may be varied to suit the taste and dress of the wearer. The use of a self-engaging material, such as that known under the trademark VELCRO, to secure the head gear about the wearer's head provides the additional benefit of a cap which is easily adjusted to the wearer's head, without the inconvenience of adjusting straps having a loose end hanging from the cap in a manner which is unsightly as well as annoying, and which permits a considerable reduction in inventory as compared to the inventory required in stocking conventional caps of various sizes.

SUMMARY OF THE INVENTION

The principal object of the invention therefore is to provide a visored cap, adjustable in size and consisting of a visor portion integral with a broad forehead portion, provided with a resilient absorbent lining and adapted to be worn in combination with an interchangeable crown portion. The eye shade of the invention is particularly useful when worn by an athlete such as a tennis player, golfer, or the like. The crown portion is provided with bands adapted to pass through slits provided at the ends of the forehead portion. Such bands are equipped with pads of mutually engaging material such as that known as VELCRO and are adapted to engage with a pad of similar material provided at the back of the crown portion, such as to provide a size adjustment means for the cap.

Many objects and advantages of the invention will become apparent to those skilled in the art when the following description of the best modes contemplated for practicing the invention is read in conjunction with the accompanying drawing wherein like reference numerals refer to like parts.

BRIEF DESCRIPTION OF THE DRAWING

FIG. 1 is a side elevation view of an example of an adjustable visored cap with interchangeable crown according to the present invention;

FIG. 2 is a top plan view thereof;

FIG. 3 is a front elevation view thereof;

FIG. 4 is a longitudinal section thereof along line 4—4 of FIG. 2;

FIG. 5 is a partial view thereof showing the adjustable fastening arrangement disengaged;

FIG. 6 is a view similar to FIG. 5 showing the fastening arrangement partially engaged;

FIG. 7 is a view similar to FIG. 1 but showing a modification of the present invention;

FIG. 8 is a top plan view thereof;

FIG. 9 is a front elevation view thereof;

FIG. 10 is a longitudinal section taken along line 10—10 of FIG. 8; and FIGS. 11 and 12 are partial detailed views thereof showing the arrangement for removably attaching the crown portion to the elastic headband.

DETAILED DESCRIPTION OF THE PREFERRED EMBODIMENT

Referring to FIGS. 1 through 4, an adjustable visored cap 10 with interchangeable crown according to the present invention comprises an eye shade portion 11 and a crown portion 13, said eye shade portion consisting principally of a single piece of material preferably substantially rigid and non-brittle, such as a plastic or light metal as aluminum or aluminum alloy, shaped or molded such as to form two integral portions defining a visor portion 12 and a forehead portion 14. The visor portion 12 is crescent-shaped and non-planar, being curved about an axis at an angle relative to a vertical axis when being worn and being slightly convex in cross section as best shown in FIG. 4. The width of the visor portion 12, as best shown in FIG. 2, is maximum at its forward portion and progressively decreases or tapers toward the temples of the wearer. The integrally formed forehead portion 14 is of substantially constant width from its forward section to its side portions, extending beyond the temples of the wearer. The forehead portion 14 is cured about a substantially vertical axis. The forehead portion 14 has a substantial width so as to cover most of the height of the forehead of the wearer, and it is provided on its interior surface with an elongated and relatively wide band or pad of substantially resilient soft material, such as foam rubber, foam resilient plastic, or the like, as shown at 16 in FIG. 4, which is cemented in place and provides a cushion and perspiration absorbent support base in engagement with the wearer's forehead. The visor and forehead portions 12 and 14 are connected by a radiused integral portion, as shown at 22, such as to provide a smooth blending of the two curved surfaces of the visor portion 12 and forehead portion 14, respectively, for the double purpose of avoiding sharp angles and of aiding in deflecting projectiles such as a rubber ball, a golf ball, or the like, impacting upon the exterior surface of the molded solid piece forming the eye shade 11 of the invention.

The crown portion 13 is made of an appropriately sewn and dome-shaped soft fabric 24 or pliable thin plastic. The crown portion 13 is removably affixed in the front to the forehead portion 14 such that its front edge reaches the integral radiused portion 22 between the forehead portion 14 and the visor portion 12. The cap is held in position upon the head of the wearer by means of elastic bands 18, for example, the ends of which are attached to the sides of the crown portion 13 by sewing, for example, and which are passed through vertical slits 20 provided at each end of the forehead portion 14. As best shown in FIG. 4, the ends of the resilient and absorbent forehead pad 16 extend proximate each slit 20. If so desired, aeration apertures may be formed through the material 24 of the crown portion 13 to provide air circulation under the crown portion. As shown in FIG. 4, the front of the crown portion 13 is attached to the lower edge of the forehead portion 14 of the eye shade 11 by fastening means 15 consisting, for example, of at least one piece of tape or fabric having adhesive properties on both sides, which is thus adapted to adhere on one side to the forehead portion 14 of the eye shade 11 and, on the other side, to the crown portion fabric 24, holding one firmly against the other. Alternatively, and preferably, the fastening means 15 may consist of a length of textile material having mutually engaging characterisitcs, such as the material known and sold under the trademark VELCRO, having its backing cemented to the surface of the forehead portion 14, and of a corresponding length of the same material sewn to the crown fabric 24.

As illustrated in FIG. 4 and in more detail in FIGS. 5 and 6, the crown portion 13 is provided at its back with a flap 26 provided proximate its edge with a pad 27 of material having interlocking characteristics, such as that known under the trademark VELCRO, said pad being affixed on the inner surface of the crown portion rear flap 26. The elastic bands or straps 18, which are permanently affixed to each side of the crown portion 13 and which are normally passed through the vertical slits 20 provided at the ends of the forehead portion 14, are similarly provided at each free end with a pad 28 of interlocking fabric, the pads 28 being disposed on the inner side of the elastic straps 18 so as to be engageable with the pad 27 when the flap 26 is folded over as shown at FIGS. 4 and 6. These pads 27 and 28 of self-adhesive interlocking material thus provide the means by which the cap is circumferentially adjustable to the head size of a wearer. As the rear flap 26 of the crown portion 13 bearing the interlocking material 27 is folded by being turned under inwardly to a position presenting the interlocking pad 27 directly opposite the interlocking pads 28 provided at the end of the strap portions 18, as best illustrated at FIG. 6, the size adjustment arrangement of the visor cap of the invention is completely hidden from sight and results in a neat appearance of the cap.

Instead of being made of two separate portions, the elastic bands or straps 18 may be made of a single piece, having both ends attached to the sides of the crown portion as previously explained or having its ends permanently fastened to the rear, or temple, portions of the forehead portion 14. If it is desired to adjust the cap to fit a larger head, the elastic band or strap 18 may simply be cut off substantially at the center of its back portion, so as to form a pair of straps or bands 18 as illustrated at FIG. 5.

As shown at FIGS. 7–10, the crown portion 13 may be modified so as to consist of a center portion **24*a* made of substantially opaque fabric provided with a pair of side portions 24*b* made of, for example, mesh material. Such a crown structure provides sheltering of the top of the head from sun rays, with its advantages when the wearer of the visor cap of the invention is bald, while the mesh side portions 24*b*** allows air circulation under the crown.

A further modification illustrated at FIGS. 7–12 consists in providing a single length of elastic band or strap 18 having its ends adjustably fastened to the rear, or temple, portions of the forehead portion 14, by being passed through a pair, or preferably three, vertically disposed slots 20. The edge of the crown portion 13 is also provided, as previously explained, with a length of mutually engaging fabric 15, a corresponding length of such fabric being fastened, such as by cementing, to the forehead portion 14 proximate its bottom. The edge of the rear flap 26 of the crown portion 13 is provided with a narrow band 27 of mutually engaging or interlocking textile material, a corresponding length of mutually engaging textile material 29 being disposed inside of the crown portion fabric 24, by being sewn thereto, at a distance slightly more than twice the width of the elastic band or strap 18 from the length 27 of mutually engaging textile material disposed at the edge of the flap 26, as best shown at FIG. 11. In this manner, the rear portion, or flap 26, of the crown portion is fastened, at will, to the elastic band or strap 18 by folding over the flap 26 and engaging together the mutually engaging lengths 27 and 29 of mutually engaging textile material, as shown at FIGS. 10 and 12. In this manner, if it is desired to wear the visor portion 11 without the crown portion 13, the crown portion may be easily removed, and crown replacements may be simply provided, if so desired.

The visor cap of the instant invention is light in weight, adjustable to different head sizes, easily put on and removed, adjustable in position, has an interchangeable crown and is relatively easy to manufacture at low cost and at high production rates. It is comfortable to the wearer and, in addition to providing shade for the wearer's head, it provides substantial protection against falling objects and projectiles at least for the eyes and the forehead portion of the head of the wearer.

Having thus described the invention by way of a practical example thereof, what is claimed as new is as follows:

1. An adjustable visored cap comprising an eye shade portion and a crown portion, said eye shade portion comprising a crescent-shaped slightly convex visor portion, a substantially broad forehead portion integral with said visor portion and extending beyond the temples of a wearer, said integral visor and forehead portions being integrally made of a single piece of molded, substantially rigid impact resistant material and being joined by an integral radiused portion, at least one substantially vertically disposed slit formed proximate each end of said forehead portion, an elongated flat pad of absorbent and resilient material affixed to the interior of said forehead portion for engagement with the forehead of the wearer, said flat pad being relatively wide and extending on the interior of said forehead portion with the ends of said pad extending proximate said slits, a crown portion removably attached to said eye shade portion and provided with a rear flap having a pad of textile material possessing mutually engaging characteristics attached adjacent the edge of said flap on the inner surface thereof, a relatively wide elastic band adjustable in length having ends passed through said slits vertically disposed on said forehead portion, said band having a rear portion for engagement with said flap folded thereover, and means comprising at least another pad of said textile material for holding said flap in position, wherein the means for removably attaching said crown portion to said forehead portion comprises at least one strip of adhesive material which is affixed on one side to said eye shade portion and on the other side to said crown portion.

2. The visored cap of claim 1 wherein the means for removably attaching said crown portion to said forehead portion comprises at least one strip of textile material having mutually engaging characteristics attached to the outer surface of said forehead portion and a corresponding strip of said textile materil attached to the inside surface of said crown portion proximate the edge thereof.

3. The visored cap of claim 1 wherein said crown portion is entirely made of opaque material.

4. The visored cap of claim 1 wherein said crown portion is made of a central portion made of opaque material and of lateral portions each made of mesh material.

5. An adjustable visored cap comprising an eye shade portion and a crown portion, said eye shade portion comprising a crescent-shaped slightly convex visor portion, a substantially broad forehead portion integral with said visor portion and extending beyond the temples of the wearer, said integral visor and forehead portions being integrally made of a single piece of molded, substantially rigid impact resistant material and being joined by an integral radiused portion, at least one substantially vertically disposed slit formed proximate each end of said forehead portion, an elongated flat pad of absorbent and resilient material affixed to the interior of said forehead portion for engagement with the forehead of the wearer, said flat pad being relatively wide and extending on the interior of said forehead portion with the ends of said pad extending proximate said slits, a crown portion removably attached to said eye shade portion and provided with a rear flap having a pad of textile material possessing mutually engaging characteristics attached adjacent the edge of said flap on the inner surface thereof, and a pair of relatively wide elastic bands each having an end immovably attached to one of the sides of said crown portion and passed through said slits vertically disposed on said forehead portion, each of said bands having a rear end portion provided with a pad of said mutually engaging textile material for adjustable engagement with said pad on said flap folded over the rear end portions of said bands, wherein the means for removably attaching said crown portion to said forehead portion comprises at least one strip of adhesive material which is affixed on one side to said eye shade portion and on the other side to said crown portion.

6. The visored cap of claim 5 wherein the means for removably attaching said crown portion to said forehead portion comprises at least one strip of textile material having mutually engaging characteristics attached to the outer surface of said forehead portion and a corresponding strip of said textile material attached to the inside surface of said crown portion.

7. The visored cap of claim 5 wherein said crown portion is entirely made of opaque material.

8. The visored cap of claim 5 wherein said crown portion is made of a central portion made of opaque material and of lateral portions each made of mesh material.

9. An adjustable visored cap comprising an eye shade portion and a crown portion, said eye shade portion comprising a crescent-shaped slightly convex visor portion, a substantially broad forehead portion integral with said visor portion and extending beyond the temples of the wearer, said integral visor and forehead portions being integrally made of a single piece of molded, substantially rigid impact resistant material and being joined by an integral radiused portion, at least a pair of substantially vertically disposed slits formed proximate each end of said forehead portion, an elongated flat pad of absorbent and resilient material affixed to the interior of said forehead portion for engagement with the forehead of the wearer, said flat pad being relatively wide and extending on the interior of said forehead portion with the ends of said pad extending proximate said slits, a crown portion removably attached to said eye shade portion and provided with a rear flap having a first length of textile material possessing mutually engaging characteristics attached adjacent the edge of said flap on the inner surface thereof, an elastic band having ends adjustably attached to the ends of said forehead portion passed through said slits vertically disposed on said forehead portion, and a second length of said textile material attached on the inner surface of said flap at a distance from said first length which is at least twice the width of said elastic band, said first length of mutually engaging textile material being normally in engagement with said second length as a result of said flap being folded over the rear portion of said band for removably fastening thereto, wherein the means for removably attaching said crown portion to said forehead portion comprises at least one strip of adhesive material which is affixed on one side to said eye shade portion and on the other side to said crown portion.

10. The visored cap of claim 9 wherein the means for removably attaching said crown portion to said forehead portion comprises at least one strip of textile material having mutually engaging characteristics attached to the outer surface of said forehead portion and a corresponding strip of said textile material attached to the inside surface of said crown portion.

11. The visored cap of claim 9 wherein said crown portion is entirely made of opaque material.

12. The visored cap of claim 9 wherein said crown portion is made of a central portion made of opaque material and of lateral portions each made of mesh material.

* * * * *